US007690085B2

(12) United States Patent
Lenhart

(10) Patent No.: US 7,690,085 B2
(45) Date of Patent: Apr. 6, 2010

(54) POLE GRIP

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 144 days.

(21) Appl. No.: 11/720,802

(22) PCT Filed: Dec. 7, 2005

(86) PCT No.: PCT/CH2005/000728

§ 371 (c)(1),
(2), (4) Date: Jun. 4, 2007

(87) PCT Pub. No.: WO2006/066423

PCT Pub. Date: Jun. 29, 2006

(65) Prior Publication Data

US 2008/0149154 A1 Jun. 26, 2008

(30) Foreign Application Priority Data

Dec. 23, 2004 (CH) ..... 2138/04
Aug. 25, 2005 (CH) ..... 1394/05

(51) Int. Cl.
*B25G 1/10* (2006.01)
*A63C 11/00* (2006.01)

(52) U.S. Cl. ..... 16/436; 280/821

(58) Field of Classification Search ..... 16/436
See application file for complete search history.

(56) References Cited

U.S. PATENT DOCUMENTS 5,110,154 A 5/1992 Street
5,312,134 A * 5/1994 Goode et al. ..... 280/822
5,328,205 A * 7/1994 Bacharach ..... 280/822
5,516,150 A 5/1996 Goode et al.
5,549,330 A * 8/1996 Wells ..... 280/822
6,264,242 B1 * 7/2001 Lenhart ..... 280/822
6,325,418 B1 * 12/2001 Lenhart ..... 280/821
6,637,773 B1 * 10/2003 Trinen et al. ..... 280/821
RE38,573 E * 8/2004 Wells ..... 280/822
7,191,495 B2 * 3/2007 Panizza ..... 16/436
2002/0067036 A1 * 6/2002 Young et al. ..... 280/819
2005/0005404 A1 * 1/2005 Panizza ..... 16/436
2006/0001255 A1 * 1/2006 Trinen et al. ..... 280/821
2006/0143867 A1 * 7/2006 Wu ..... 16/436

FOREIGN PATENT DOCUMENTS

DE 197 51 978 A1 5/1999
DE 298 01 388 U1 7/1999
WO 2004/052476 A1 6/2004

* cited by examiner

*Primary Examiner*—Victor Batson
*Assistant Examiner*—Matthew Sullivan
(74) *Attorney, Agent, or Firm*—Sughrue Mion, PLLC

(57) ABSTRACT

The invention relates to a pole grip (1), particularly for walking sticks, trekking poles, alpine ski poles, cross-country ski poles and Nordic walking poles, comprising a grip body (3) and a hook-like device (14) for attaching a hand-retaining device particularly provided in the form of a hand strap or a glove. Latching means (6, 11) are placed in the area of the hook-like device (14) in such a manner that a strap-shaped, ring-shaped or eyelet-shaped device (33), which is inserted from above into the hook-like device (14) and which is provided on a hand-retaining device, is fixed in the hook-like device (14) in a self-latching manner. This simple and self-latching mechanism enormously simplifies use and is preferably combined with a safety release in the event of a heavy load acting in the opening direction of the hook-like device.

29 Claims, 11 Drawing Sheets

POLE GRIP

TECHNICAL FIELD

The present invention relates to a pole grip, in particular for walking sticks, trekking poles, downhill ski poles, cross-country ski poles and Nordic walking poles. The pole grip has a grip body with a hook-like device for fastening a hand-retaining device in particular in the form of a hand strap or of a glove. The present invention also relates to a hand-retaining device which cooperates in optimum fashion with such a pole grip.

PRIOR ART

In the case of such a device, which is known, for example from U.S. Pat. No. 5,516,150, a hook is provided on the pole grip, and a rigid bow-like device formed from a curved metal element is provided on the associated glove, in the region between the thumb and forefinger. The bow has its long leg introduced into a narrow slot of the hook, and the hook-like device fixes the bow, and thus the glove, on the pole grip.

Provision is made here for the slot to be widened slightly at the bottom of the hook, which means that, when the bow is moved into the hook, it initially forces the two legs of the hook apart from one another to a slight extent, and that it is only when the bow has been pushed into the widened portion that the legs spring back into the original position.

Elastic deformation of the hook-like device is thus used in order to fix the bow easily in the hook and to avoid the situation where the bow can easily slide out of the hook.

One of the problems with such devices is the fact that repeated deformation of such components, which are usually formed from plastic or metal, is undesirable on account of signs of fatigue.

There is also the particular problem of the elastic deformation behavior of materials being highly dependent on temperature. It is thus also the case that the fixing action which is achieved by the deformation is neither adjustable nor constant for different temperatures.

This is absolutely unacceptable in the sporting arena in particular, since very large differences in temperature are unavoidable, on the one hand, on account of different weather conditions and, on the other hand, as a result of heating or warming up during use.

DESCRIPTION OF THE INVENTION

This is where the invention comes in. The object of the invention is thus to provide a pole grip which is improved in relation to the prior art. The concern here in particular is to improve a pole grip for walking sticks, trekking poles, downhill ski poles, cross-country ski poles and Nordic walking poles, these having a grip body with a hook-like device for fastening a hand-retaining device in particular in the form of a hand strap or of a glove.

This object is achieved in that displaceable or rotatable latching-in means are arranged in the region of the hook-like device such that a loop-like, ring-like or eyelet-like device, which is pushed or fitted into the hook-like device preferably essentially from above and is provided on the hand-retaining device, is fixed in the hook-like device with self-latching action.

The core of the invention is thus to use essentially no material deformation on the hook in the case of a self-latching mechanism for fastening a hand-retaining device on the pole grip; rather, there are mechanisms in which, when a loop-like, ring-like or eyelet-like device is pushed into a latched-in position, a corresponding latching-in means is either displaced or rotated. It is thus possible correspondingly to provide a specific elastic mounting arrangement for these latching-in means, the arrangement, in particular, being less susceptible to wear, being adjustable, if appropriate, and having a lower level of temperature dependence in respect of the forces.

A first preferred embodiment is characterized in that the hook-like device is arranged in the top region of the pole grip, on the hand side, and in that the hook-like device comprises a retaining peg or retaining pin which is arranged preferably essentially parallel to the pole axis (although a specific amount of inclination may also be present) and is offset in the direction of the hand side from the grip body to form an introduction slot, the depth of the introduction slot being greater than the width and the thickness of the retaining peg or retaining pin. Offset does not necessarily mean that the retaining peg or retaining pin has to project beyond the contour of the grip body; it is also possible for the retaining peg or retaining pin to be positioned in a recess which is open toward the top and rear and is provided specifically for this purpose in the grip body. It has typically been found that the hook-like device advantageously has a width in the range of 3-15 mm, preferably in the range of 4-10 mm, the hook-like device having an essentially oval or rectangular (possibly with rounded edges) cross section, in particular preferably at least in certain sections perpendicular to the pole axis, in which case preferably the short main axis is directed toward the grip body. The introduction slot typically has a depth in the range of 5-30 mm, preferably in the range of 10-15 mm. It is possible here, for example, to provide a slight convexity in the hook-like device directly opposite the latching-in means.

According to a further preferred embodiment, the hook-like device is formed integrally on the grip body. In particular in combination with the mechanism which is described hereinbelow, and in the case of which a recess is provided in the pole grip for accommodating the mechanism, it preferably proves to be expedient to design the hook-like device as a separate component. This is then fastened on the grip body via fastening means, preferably once the mechanism has been inserted into the recess of the grip body. This can be realized, for example, by the hook-like device having, beneath the hook, a fastening plate by means of which the hook-like device can be fastened on the grip body (for example by means of a screw or rivet or via a clip mechanism) from the hand side.

As has already been explained, according to another preferred embodiment the grip body is provided, from the hand side, with a recess which accommodates a displaceably (or also rotatably) mounted element, in particular preferably in the form of an arresting block, on or in which latching-in means are arranged, it being possible for these latching-in means to be formed either integrally with the arresting block or as a separate component, and in the latter case this separate component, for example in the form of a restraining nose, can be connected to the arresting block either in a fixed manner or via a movable mechanism.

The arresting block (and/or a latching-in means provided therein) is advantageously guided so as to be displaceable parallel to the direction of the recess, but it is also possible to mount it for rotation. The arresting block is braced against the hook-like device, which is arranged in front of the recess, via a spring (this also covering, in general, resiliently elastic elements), in particular preferably via a helical spring (or a leaf spring). This results in the above-mentioned self-latching mechanism.

In order that the hand-retaining device can also be separated from the pole grip again, means should be provided in order to push the latching-in means back and release the hand-retaining device from the hook. This is possible, for example, by it being possible for the arresting block (and/or a latching-in means provided therein) to be displaced from the outside, counter to the spring force, via at least one actuating button, the self-latching mechanism being released in the process, in which case, for this purpose, slots are provided laterally, in particular preferably in the grip body, in relation to the recess and, via these slots, actuating buttons arranged on both sides are operatively connected to the arresting block, for example by a fixed connection being created between these two elements via a crosspiece or pin. However, it is also possible, for this purpose, to provide in or on the grip body, in the top region thereof, and at the front or rear, e.g. on both sides of the hook-like device, at least one displaceable, rotatable or tiltable actuating button which is operatively connected to the arresting block, for example by a fixed or rotatable connection being created between these two elements via a crosspiece or pin.

It is basically possible for the arresting block to be fitted in a rotatable or displaceable manner on the grip body by a wide variety of different methods. It is thus possible, for example, to design the uppermost region in its entirety, that is to say, as it were, the head region of the pole grip, as the arresting block, in which case, to a certain extent behind the same and fixedly connected to the bottom part of the pole grip, or formed integrally therewith, the hook-like device is provided so as to allow a loop of a hand-retaining device to be fixed between the arresting block and the hook-like device. The arresting block, as head of the grip, may be rotatable here as a whole, it being possible for the rotary axial element to be, for example, at the front, i.e. remote from the hook, in the bottom region of the arresting block. In this case, the rotary axial element is located, for example, preferably essentially parallel to the direction of the slot between the hook and arresting block.

One possible embodiment is characterized by the provision, in or on the arresting block, of at least one activating button by way of which the retaining means arranged in the arresting block, preferably in the form of a pin, can be displaced counter to a spring force, the self-latching mechanism being released in the process. It is also possible for the grip body to be provided from the hand side, and from above, with a recess which accommodates a displaceably and/or rotatably mounted element in the form of an arresting block in which latching-in means are arranged, the arresting block being braced in the downward direction for emergency activation via an axial helical spring which is arranged in a cavity of the pole grip and the stressing of which can be adjusted preferably via an adjusting nut.

Another preferred embodiment is characterized, for example, in that the grip body is provided, from the top side, with a recess which accommodates a displaceably and/or rotatably mounted element, in particular preferably in the form of an arresting block, on which latching-in means are arranged. If the recess is provided from above, it is then possible, without obstructing assembly or installation, to form the hook-like device, for example, integrally with the grip body, for example in the form of a simple slot or cutout arranged in the grip body on the hand side. The arresting block here can be mounted in a rotatable manner about a horizontal axial element, which is arranged between the hook-like device and grip body preferably essentially parallel to the plane of the slot, and it can be braced against the hook-like device, arranged on the hand side, via a spring, in particular preferably via a helical spring or a leaf spring. The arresting block can then be tilted from the outside, counter to the spring force, via at least one actuating button, the self-latching mechanism being released in the process, in which case, for example, the actuating button is provided essentially on the top side of the pole grip, that is to say the arresting block is exposed, to a certain extent, from above and a part or portion, or a sub-surface, of the arresting block forms the actuating button.

Another preferred embodiment is characterized in that the latching-in means are designed in the form of a restraining nose which has a beveled flank toward the top, in particular preferably as seen in the direction of introduction, and which, in the position in which it is braced against the hook-like device, defines, in the downward direction, a region for the loop-like, ring-like or eyelet-like device which is restricted in respect of a preferably adjustable force. It is possible here for this restraining nose to be arranged either on the arresting block or, as it were opposite, on the hook-like device.

The latching-in means may preferably be designed in the manner of a safety mechanism such that, in the event of loading in the direction of the opening of the hook-like device which goes beyond a normal usage force, emergency release of the loop-like, ring-like or eyelet-like device takes place, this being similar to a mechanism which is also known in respect of ski bindings. This can be realized either via elastic deformation of this nose, or in the region of this nose, or else, and this is the preferred variant because it can be much better controlled and possibly even adjusted, by the restraining nose being mounted in a rotatable manner about a preferably horizontal axial element arranged essentially perpendicularly to the opening direction of the recess. Rotation in the upward direction, to release the region in the upward direction, is only possible here counter to a defined and, as has already been mentioned, preferably adjustable force. The restraining nose may be braced by way of a leg spring, by way of an elastomer spring or by way of a helical spring, or by way of a combination of such resilient elements, into the rotary position in which it closes off the region, this bracing in particular preferably being adjustable, in which case safety activation takes place only under a force of more than 80-250 N. A further analogous embodiment of the pole grip is characterized in that the restraining nose is mounted in a displaceable manner, in which case displacement in the upward direction to release the region is possible counter to a defined and preferably adjustable force, as specified, and the force is preferably ensured via a spring or a resilient element.

Moreover, safety activation can also be realized via a yielding action in the region of the hook-like device. For this purpose, the hook-like device may be configured such that it can be displaced or tilted about an axial element, counter to an elastic force, in the direction of the hand side to release the region. As an alternative, or in addition, it is possible to provide a resilient region on the hook-like device on the slot side. This resilient region can be realized, for example, via a leaf spring or an elastic portion (specifically a soft elastic polymer portion or the like).

Further preferred embodiments of the pole grip according to the invention are described in the dependent claims.

Hand-retaining devices which are particularly well suited for being used with an abovementioned pole grip are those which have a movable loop or eyelet in the V region between the thumb and forefinger, e.g. a hand-retaining device such as a hand strap which can be fastened on the hand or a glove which has a movable loop or eyelet between the thumb and forefinger.

Such a hand-retaining device interacts with a pole grip as described above in the manner of a key and lock or plug and socket. The small loop is particularly comfortable and is not obtrusive, in which case such a glove or such a hand-retaining device is also suitable for biathlon or the like.

The loop is, particularly preferably, a loop which is made of a flexible material with a sufficient level of inherent rigidity to stabilize it in a position in the space between the thumb and forefinger, which allows it to be introduced straightforwardly over the hook or retaining peg and which, conversely, cannot be felt, or can only barely be felt, during use. Possible examples of loops are those made of a cable or wire, which may, if appropriate, be surface-coated. Examples of other elements which are basically also suitable as material for such loops are textile fibers which are encased in a woven-fabric sheath, have limited expansion capability and are stable in relation to tension, or retaining elements which are braided in a cord-like or cable-like manner, using corresponding materials such as Aramid, Kevlar, Dyneema, etc. If use is made of such materials for the loop, cords with a thickness of 1-5 mm are most suitable, a thickness of 2-3 mm being preferred. In order to impart a sufficient level of inherent rigidity to the loop, such cords may be provided with stiffening elements, for example a "core" made of monofilament nylon or enwoven fibers consisting of a relatively stiff material, for example nylon or thin metal wires. It has been found that a cable with a thickness in the range of 0.5-2.5 mm, preferably in the range of 1-2 mm, is particularly suitable.

The, for example, braided or twisted cable can be coated with another material, for example copper or plastic. As an alternative, it is possible to produce the loop from a plastic material, also, for example, in band form, preferably from a fiber-reinforced plastic, for example polyamide, PE, PP or the like being suitable, in which case combined materials with a layered construction are also possible, and in particular preferably reinforcements with fibers for example made of Aramid may be provided.

The loop preferably projects by between 5-20 mm, in particular by between 5-10 mm, beyond the V region between the forefinger and thumb. In this case, the direction of the loop, to a certain extent, runs essentially along the angle bisector between the thumb and forefinger.

It is possible for the loop to be adjustable, this adjustability being provided, on the one hand, in order to adjust the length specifically to the user, but also, when the loop is not required, in order to retract the same so that it cannot be felt during use. It is also possible for the loop to be stowed, when not in use, in a small pocket, which is provided for this purpose in the hand-retaining device, likewise in the V region between the forefinger and thumb. This latter possibility is particularly straightforward in design terms and, as far as the inherent rigidity of the loop is concerned, on the one hand, the loop can be accommodated in such a pocket and, on the other hand, if not specifically manipulated, it remains concealed, essentially without any special measures having to be taken in the pocket, during use of the hand-retaining device.

In order to ensure that the forces which act on the loop are coupled as well as possible to the hand-retaining device, the wire/the cable of the loop can be guided in the direction of the wrist, at least in part, in or on the hand-retaining device. It is also possible to provide a combination with an adjustable device like that described in DE 197 51 978 C2, the disclosure of which is expressly included in this respect. Instead of the rigid connecting element cited in this document, a flexible loop is simply provided. The loop is considerably less troublesome in particular when the glove is used without the pole.

Further preferred embodiments of the hand-retaining device according to the invention are described in the dependent claims.

BRIEF EXPLANATION OF THE FIGURES

The invention will be explained in more detail below with reference to exemplary embodiments, in conjunction with the drawings, in which.

WAYS OF IMPLEMENTING THE INVENTION

Figure 1:
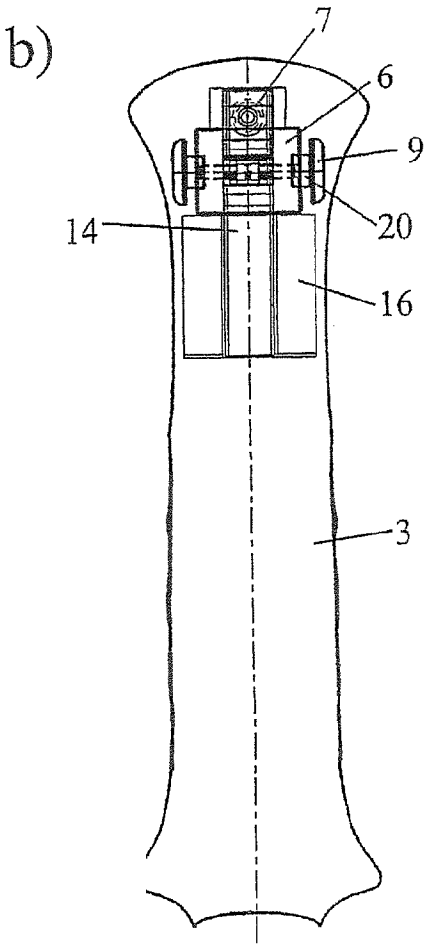
FIG. 1 shows different views of a pole grip according to a first exemplary embodiment of the invention, a) illustrating a lateral, partially transparent, view, b) illustrating a view from behind (hand side), c) illustrating an exploded view from the side, d) illustrating a section along line A-A in FIG. 1*c*), *e*) illustrating an exploded view in a section along line A-A in FIG. 1*c*), *f*) illustrating a perspective exploded view, and g) illustrating an alternative hook-like device with safety-activation element on the hook.
Figure 1:
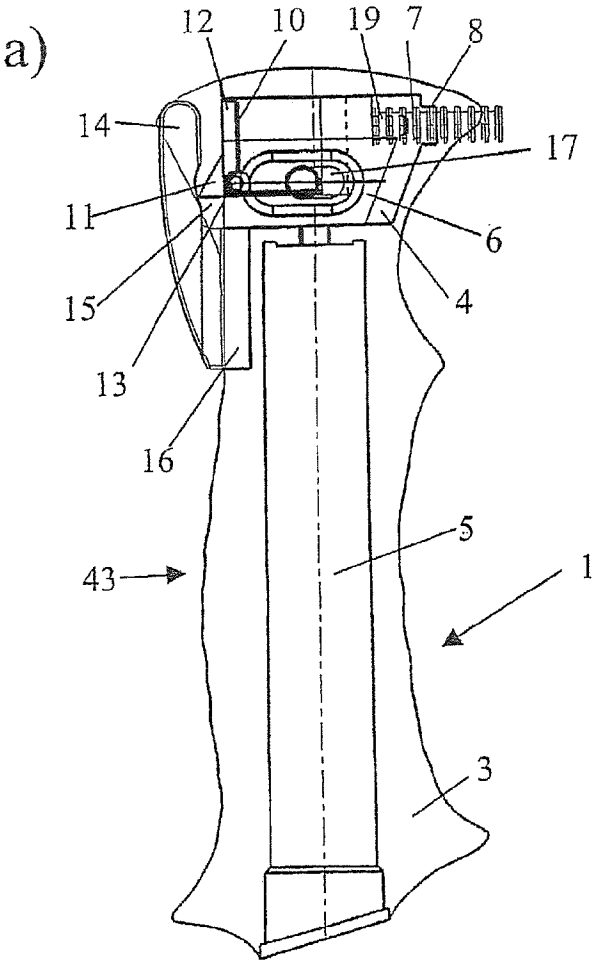
Figure 1:
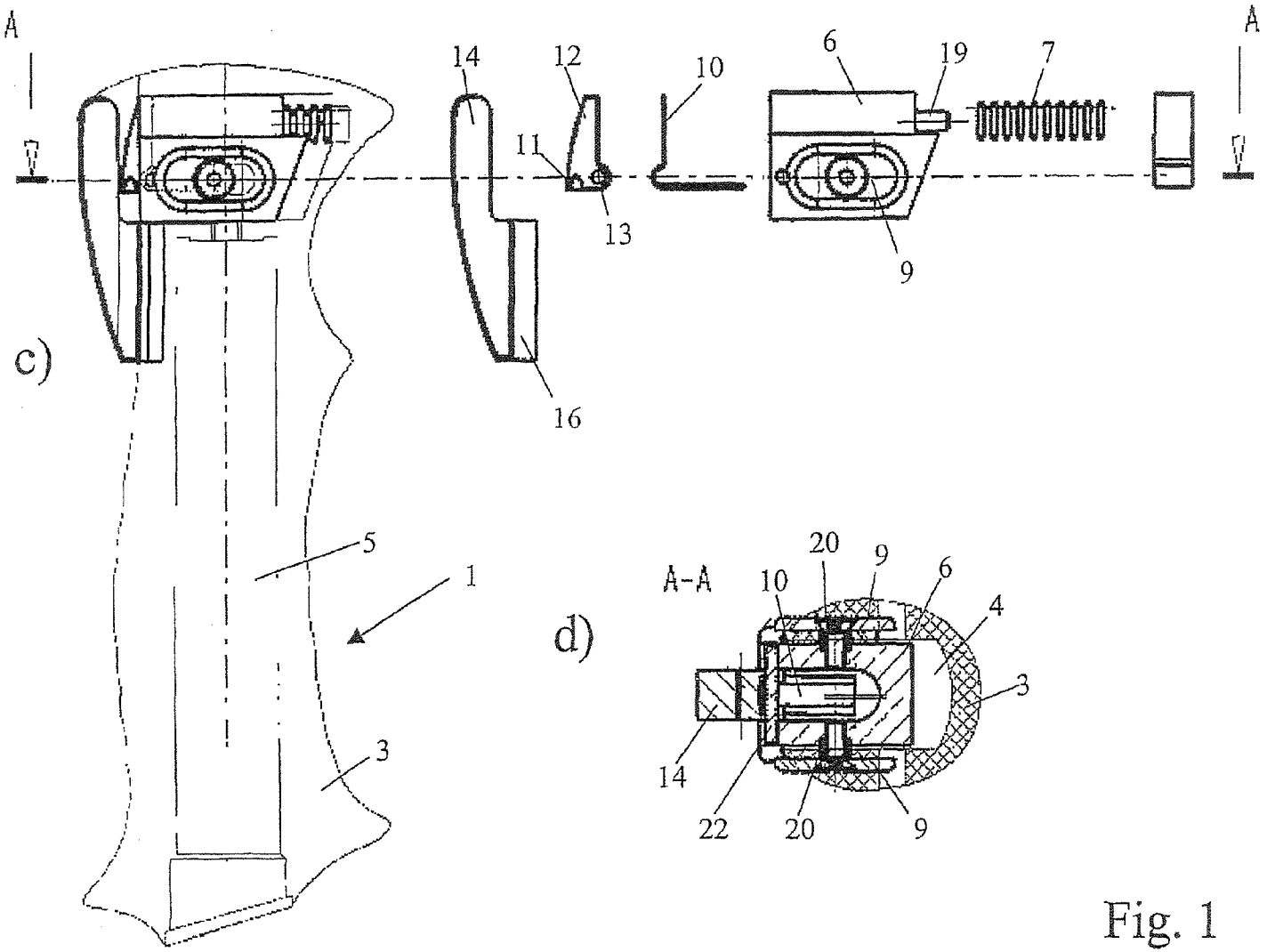
Figure 1:
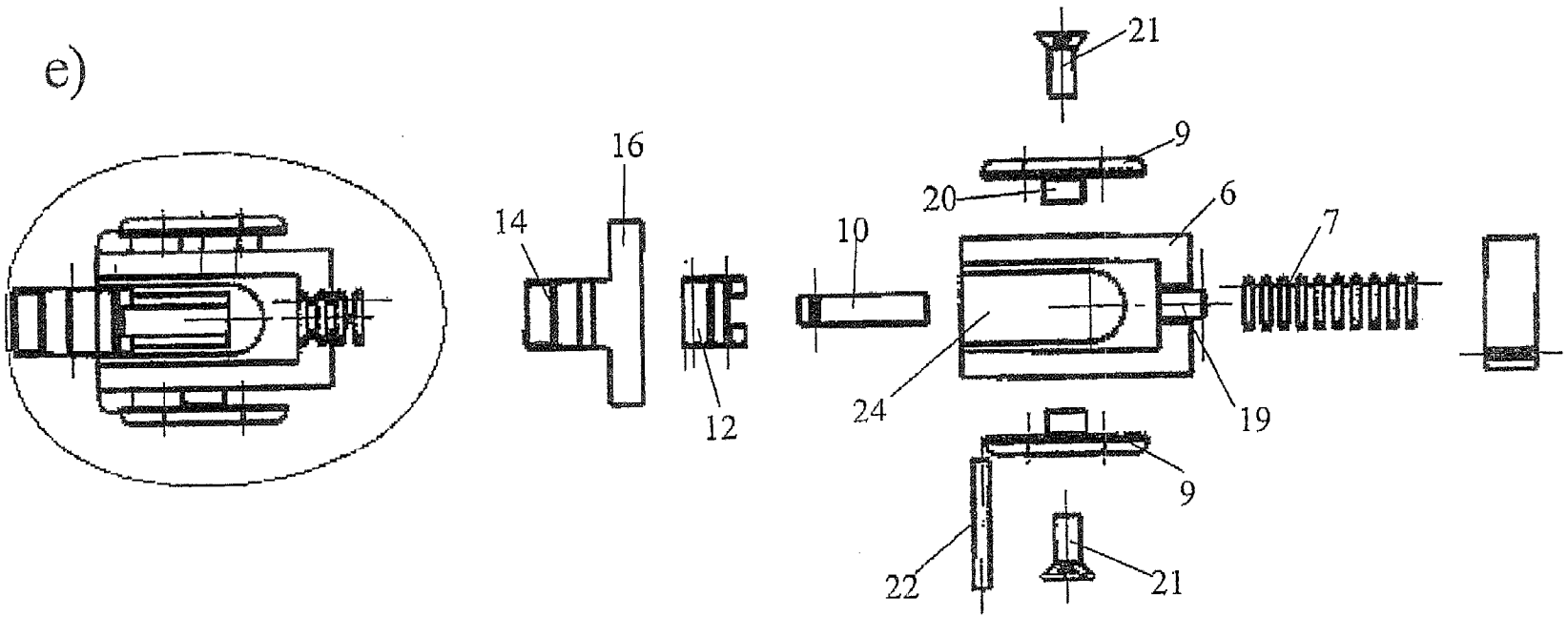
Figure 1:
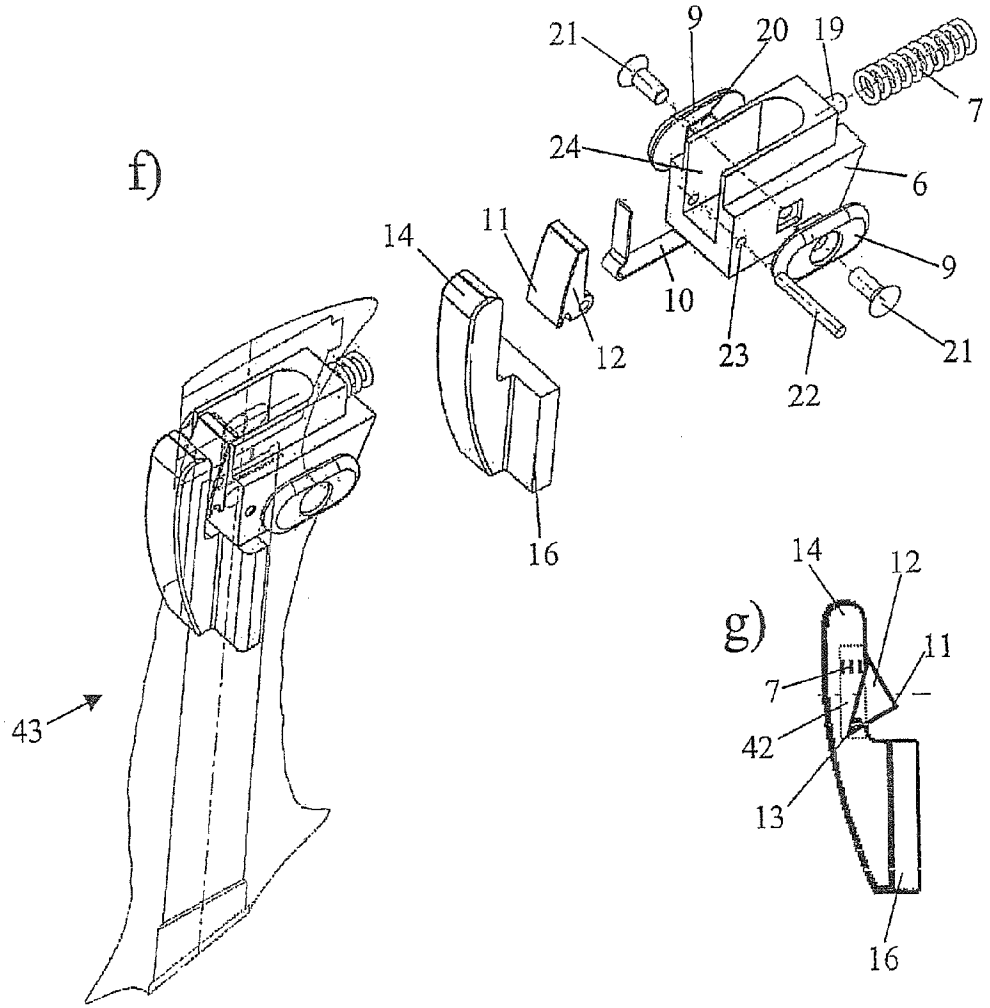

FIGS. 1*a*)-*f*) illustrate different views of one exemplary embodiment of a pole grip according to the invention. The pole grip 1 comprises a grip body 3, which is usually produced from a plastic material by injection molding. As seen from beneath, the grip body 3 has a recess or a cavity 5 into which the pole, which is formed, for example, from an aluminum shaft or a carbon-fiber or glass-fiber shaft, can be pushed and fastened therein.

At its top end, the pole grip 1 has a recess 4 which is designed from the hand side 43, as it were, as a blind hole. An arresting block 6 is provided in this recess 4, which typically has a height in the range of 10-30 mm and a width in the range of 3-20 mm. This arresting block 6 is guided in a displaceable manner in the recess 4, and is braced in the direction of the opening of the recess 4 via a spring 7. The spring 7 is a helical spring which is guided, at one end, in the recess, in a stop bore 8 which is configured as a cylindrical blind hole, and, at the other end, on a guide peg 19 on the arresting block 6.

The recess 4 additionally has two through-slots 17 which lead laterally out of the grip body 3. The arresting block 6 for its part, in these regions, has bores in which a respective actuating button 9 can be fastened on each side. The actuating button 9 has in each case a crosspiece 20 directed toward the arresting block 6 and, when the arresting block 6 is pushed in, it is fastened in the arresting block 6 from the outside through the abovementioned lateral slots 17, for which purpose a screw or fastening pin 21 can be used in each case. This means that the actuating button 9 can be displaced from the outside via manipulations of the actuating buttons 9, this being such that, in the normal position, the arresting block 6 is located to the maximum possible extent in the direction of the hand side as a result of the force of the spring 7, this maximum position preferably being determined by the hand-side end of the slot 17. The arresting block 6 can be pushed into the recess 4, counter to the force of the spring, from the outside, this releasing the arresting mechanism for the hand-retaining device.

A hook-like device ensures that the hand-retaining device is actually secured on such a pole grip. This hook-like device comprises a retaining peg 14 which is arranged on the hand side. The retaining peg 14 is offset slightly in the direction of the hand from the actual pole grip, a slot which typically has a depth of at least 10 mm being formed therebetween.

For easier assembly, the retaining peg 14 is connected to a fastening plate 16 or formed integrally therewith. The fastening plate 16 is located beneath the retaining peg 14 and can be inserted in a recess provided for this purpose in the pole grip 3, and fastened therein. This modular construction is preferred since it is thus possible for the retaining peg 14, which is naturally arranged in front of the recess 4, to be placed in position once the elements which have to be arranged in the recess 4 have been inserted into the recess 4.

The arresting block 6, for its part, likewise has a recess 24, which is bounded laterally and at the bottom but is open at the top. The safety-activation element 12 is mounted in a movable manner in the recess 24. For this purpose, the safety-activation element 12 is mounted in the arresting block 6 such that it can be rotated by way of an axial pin 22. This rotatable mounting, in turn, is counter to a spring force, a leg spring 10 being provided in this case. This leg spring, on the one hand, rests on the base of the recess 24 and, on the other hand, rests on the rear side of the safety-activation element 12. The spring force thus retains the safety-activation element 12 in its closed position, that is to say in that position in which the restraining nose 11 of the safety-activation element 12, together with the retaining peg 14, defines a closed-off region 15, in which the loop of the hand-retaining device ends up located. It is also possible, instead of the leg spring 10, to use a helical spring or an elastomer spring or the like, or combinations of such resilient elements, which is then for example in operative connection with the rear wall of the recess 24. Use of a helical spring may be advantageous, in particular, at low temperatures and, moreover, allows the restraining force of the nose 11 to be adjusted. The safety-activation element 12 may have in the downward direction, as can be seen in FIGS. 1*c*) and *f*) in particular, a notch, in order that the cable can be arrested to better effect in the region 15.

As has already been mentioned, the hand-retaining device has a loop 33, which is guided over the retaining peg 14. If the loop 33 is guided over the retaining peg from above and pulled downward, then the entire arresting block 6 is displaced into the recess 4 because, in the case of pressure being exerted from top to bottom, the oblique top flank of the safety-activation element 12 pushes the arresting block 6 rearward, counter to the spring force, and the gap between the retaining peg and grip body is released. Once the loop has reached the region 15, the entire arresting block springs back again toward the retaining peg 14, as a result of the spring force of the spring 7, and the region 15 is closed. The hand-retaining device is thus automatically fastened/latched in on the grip body without any further manipulations being necessary.

If the loop of the hand-retaining device is to be removed again from the slot between the retaining peg and grip body, then the entire arresting block 6 can be displaced upward, counter to the spring force, via the actuating buttons 9, in which case the nose 11 releases the region 15.

In addition to this means of automatically fastening the hand-retaining device on the grip body, a safety-activation mechanism is provided. For this purpose, the safety-activation element 12 can be opened upward counter to a spring force, this being done with the arresting block pushed all the way up to the retaining peg. If the loop is subjected to a pronounced force in the upward direction (for example in the event of a fall), then the safety-activation element 12 rotates about the axial element 13 such that the region 15 is released and thus the loop, and correspondingly the hand-retaining device, is released from the grip body.

As is illustrated in FIG. 1*g*), the safety mechanism may also be provided on the retaining peg. For this purpose, the retaining peg has a recess 41 in which the safety-activation element 12 is mounted such that it can be rotated about an axial element 13. A spring 7 is again provided, in this case a helical spring, which defines the necessary activating force. In this case, it is possible, for example, to adjust the restoring force of the spring 7 via a screw which can be actuated on the retaining peg from the outside, on the hand side. The screw can be screwed in, for example, to shorten the spring, and the restoring force of the spring is thus increased.

Figure 2:
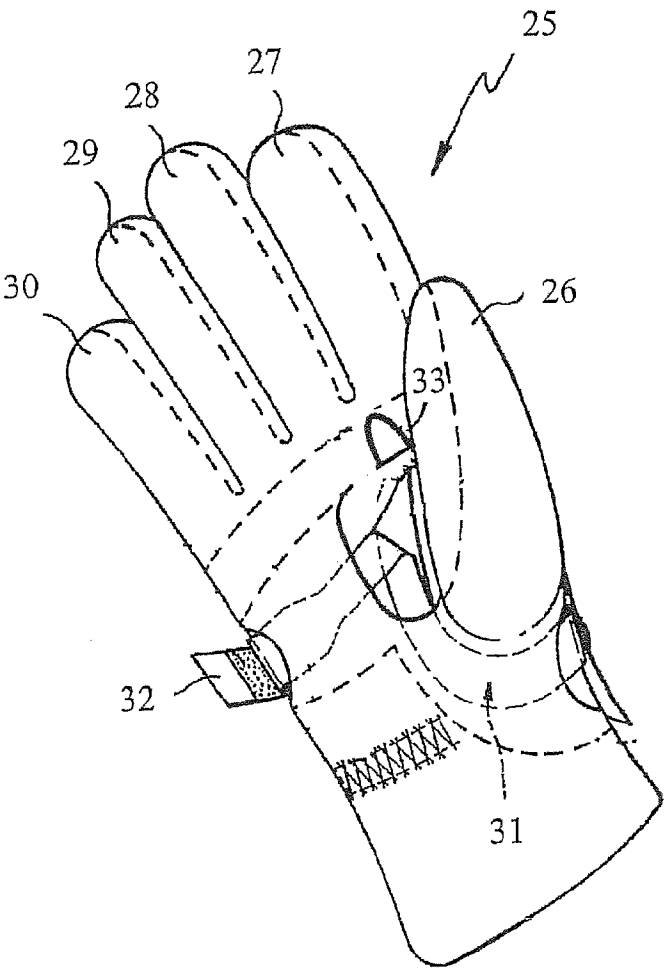
FIG. 2 shows a hand-retaining device with a loop between the thumb and forefinger.

FIG. 2 shows a hand-retaining device which is configured as a glove 25, and this glove 25 basically has a fastening guide such as that described in DE 197 51 978 C2. In respect of the details of this fastening guide, which comprises, inter alia, an encircling fastening device 31 as well as adjusting means 32 which may be designed, for example, as a touch-and-close fastener, reference is made to DE 197 51 978 C2.

Instead of the hook-like connecting element which is portrayed in DE 197 51 978, however, a loop 33 is arranged in the V region between the thumb 26 and forefinger 27 in this case. The loop is produced from cable, for example stainless steel, Aramid or the like with a thickness of 1.5 mm, the cable being a twisted cable which may be provided, if appropriate, with a coating made of plastic or metal or may have a tube of brass positioned around it or has a sheath made of, for example, thermoplastically integrally formed polymer material. The loop is preferably produced from a slightly inherently rigid cord portion made of braided Dyneema® (DSM) (or a plastic material with similar properties) with a thickness in the range of 1.5-2.5 mm. Where this document refers to a cable, in conjunction with the loop, then this should also cover such a loop for example made of Dyneema.

Figure 3:
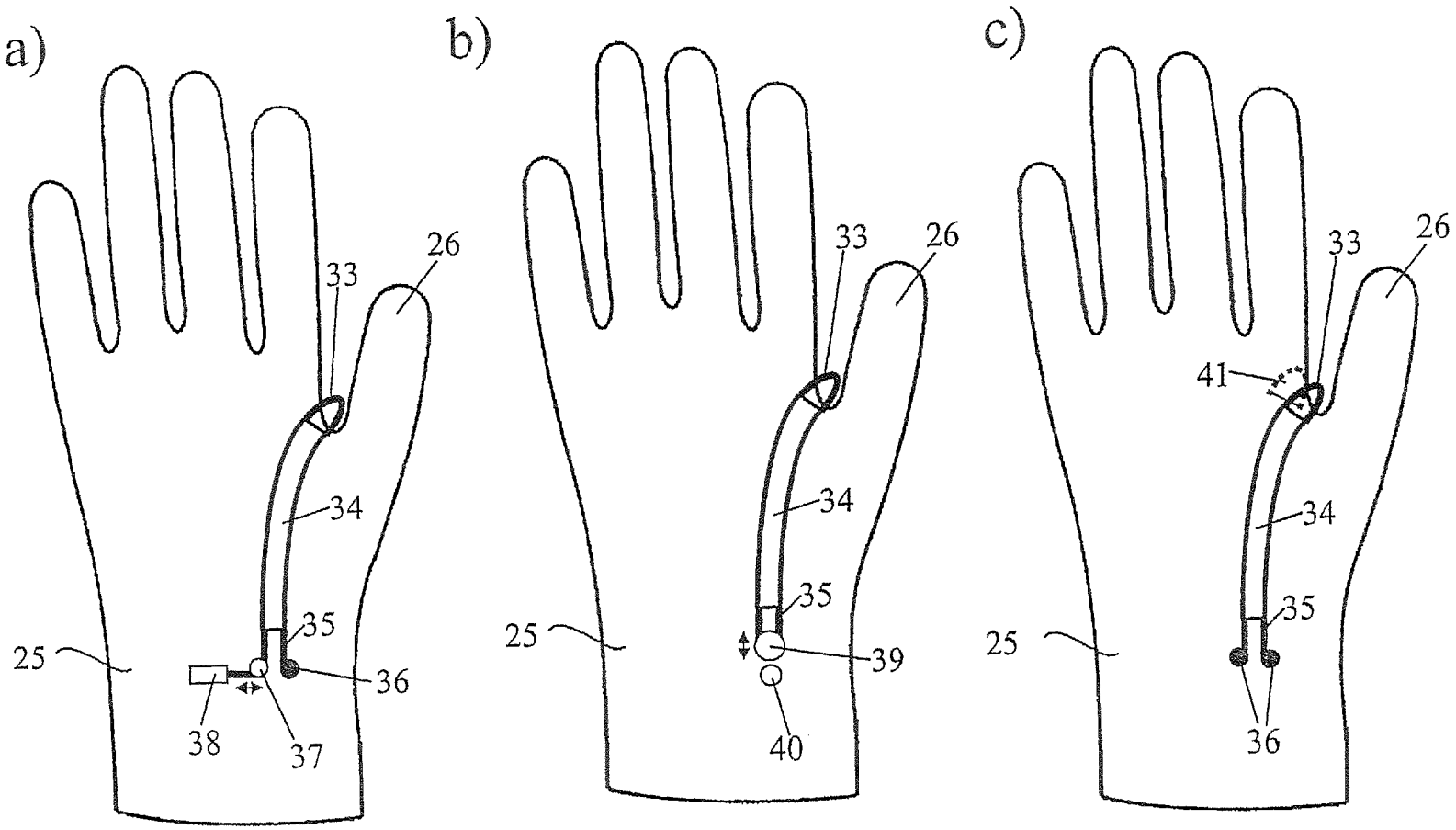
FIG. 3*a*)-*c*) show different examples of hand-retaining devices with loops between the thumb and forefinger.

The loop 33 should be fastened on the hand-retaining device such that the forces which occur during use of the pole are distributed to good effect over the hand. This is ensured in the case of a hand-retaining device according to FIG. 2. Alternative options are illustrated in FIG. 3. In FIG. 3*a*), a cable 35 is fixed, in the first instance, at one end at a fastening 36 in the palm of the hand. It is then guided through a guide sleeve 34 to the V between the forefinger and thumb 26. The actual loop 33 is exposed there and the cable 35 is guided downward, once again, through the guide 34. Provided at the bottom end of the guide sleeve 34 are a deflecting means 37 and a fastening 38, at which the cable 35 can be adjusted in a variable manner (cf. arrow). The length of the loop 33 can thus be adjusted in adaptation to the user, and the forces which occur are distributed to good effect over the glove. It is further possible for the cable 35 to be fully retracted, in which case there is no loop 33 projecting outward. This is advantageous, in particular, when the glove is not to be used in conjunction with the pole grip. In contrast to other solutions, in which connecting elements have to be removed from the glove, this solution is advantageous because the connecting element, in other words the loop, is concealed in the hand-retaining device rather than having to be removed therefrom.

Another option is illustrated in FIG. 3*b*). In this case, the cable 35 is configured as an encircling cable which is adjusted in length at its bottom end, at a button 39. It is possible to provide a further button 40, which is arranged further below and via which the cable 35 can be retracted if the loop is to be concealed.

Finally, FIG. 3*c*) illustrates an option in which the cable is fixed at the bottom via the means 36. The loop 33 cannot be adjusted in length here. In order, nevertheless, for it to be possible for the loop to be concealed when not in use, a small pocket is provided in the V region between the thumb and forefinger. When not in use, the loop 33 can be pushed into this pocket 41, which has an opening at the bottom, and it is thus kept out of the way.

It is also possible for the hand-retaining device 25 to be in the form of a hand strap which is worn over a glove, or over the bare hands, and has a loop 33. If a conventional hand strap is used, then the mechanism serves as a safety-activation means; if use is made of a hand strap which is fastened on the hand (usually by the hand strap being guided both over the wrist and between the thumb and forefinger and being fastened, for example, with a touch-and-close fastener), then the use is equivalent to the glove solution like that indicated above.

Figure 4:
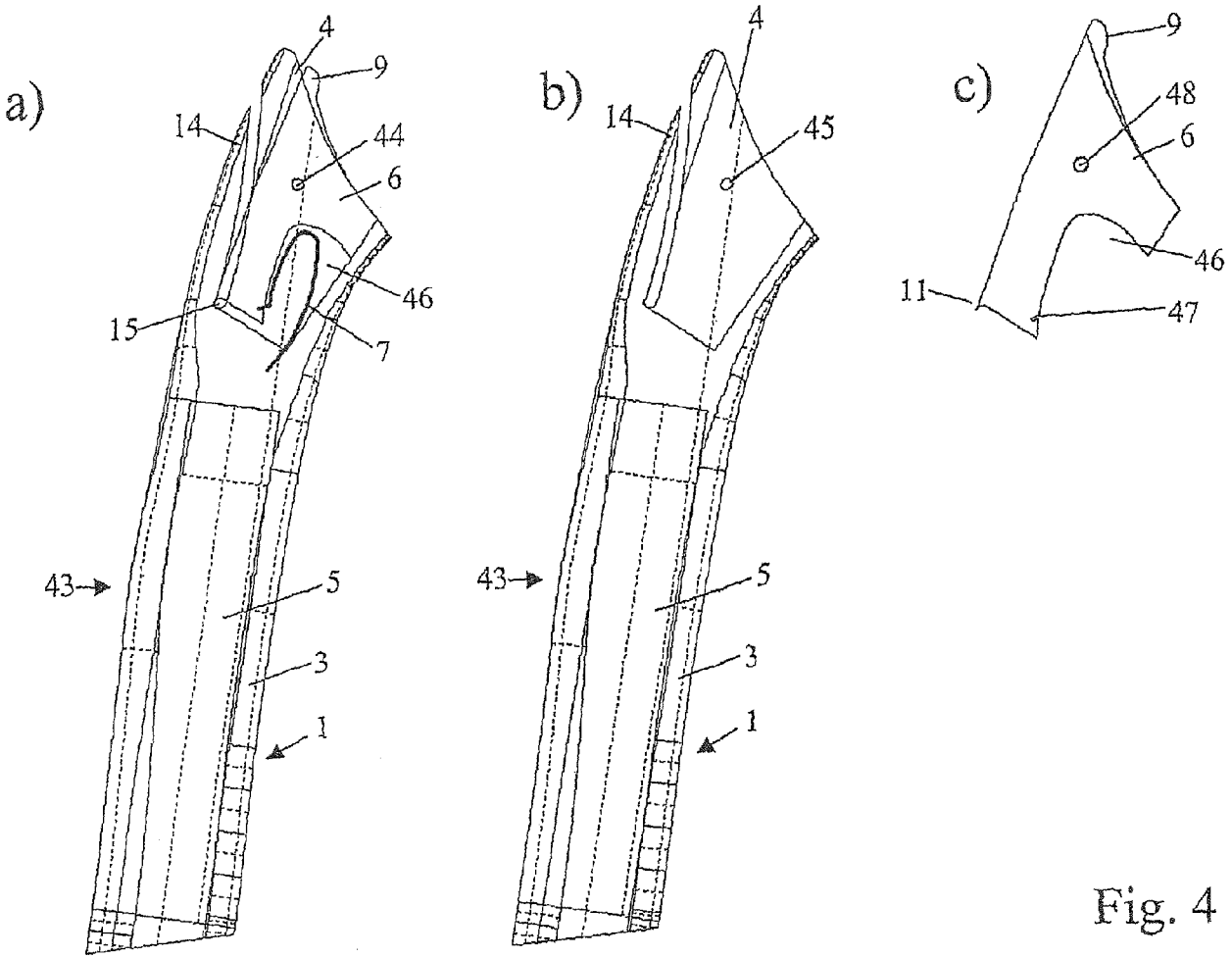
FIG. 4 shows different views of a pole grip according to a further exemplary embodiment, a) illustrating a lateral view with arresting block inserted, b) illustrating a lateral view without an arresting block, and c) illustrating an arresting block on its own.

A further exemplary embodiment is illustrated in FIG. 4, although this figure illustrates a cross-country ski pole grip or a Nordic walking pole grip rather than a downhill ski pole grip. In this case, rather than being formed separately from the grip body 3, the hook-like device 14 forms a constituent part of the grip body. The hook-like device is realized by a slot which is provided in the grip body 3. Correspondingly, the recess 4, which is provided for accommodating the arresting block 6, is made from above. In this exemplary embodiment, then, it is additionally the case that the arresting block 6, rather than being displaceable, is mounted in a rotatable manner, about an axial element 44. Correspondingly, the actuating button 9 is arranged at the top, and tilting of the arresting block 6 results in the enclosed region 15 being released. In the exemplary embodiment according to FIG. 4, for the purpose of bracing the arresting block 6, a leaf spring 7 is provided in a corresponding recess 46 in the arresting block 6. A restraining nose 11 is formed integrally on the arresting block 6, this nose 11 having an undercut in the case of the exemplary embodiment according to FIG. 4. Correspondingly, this exemplary embodiment does not have any safety-activation means; rather, when the loop is subjected to pronounced pulling in the upward direction out of the slot, the loop takes a firm hold in the device.

It should be pointed out that it is also possible for the entire top region of the pole grip 1 to be of a rotatable or displaceable configuration, as long as the possibility of automatic latching-in is provided. There is therefore no need to provide a recess, as is the case in the exemplary embodiment according to FIG. 4 (but equally also in the exemplary embodiment according to FIG. 1); rather, it is also possible for the entire arresting block 6 to be designed as the uppermost region, or as the head, of the pole grip and for this to be mounted either in a displaceable or rotatable manner.

Figure 5:
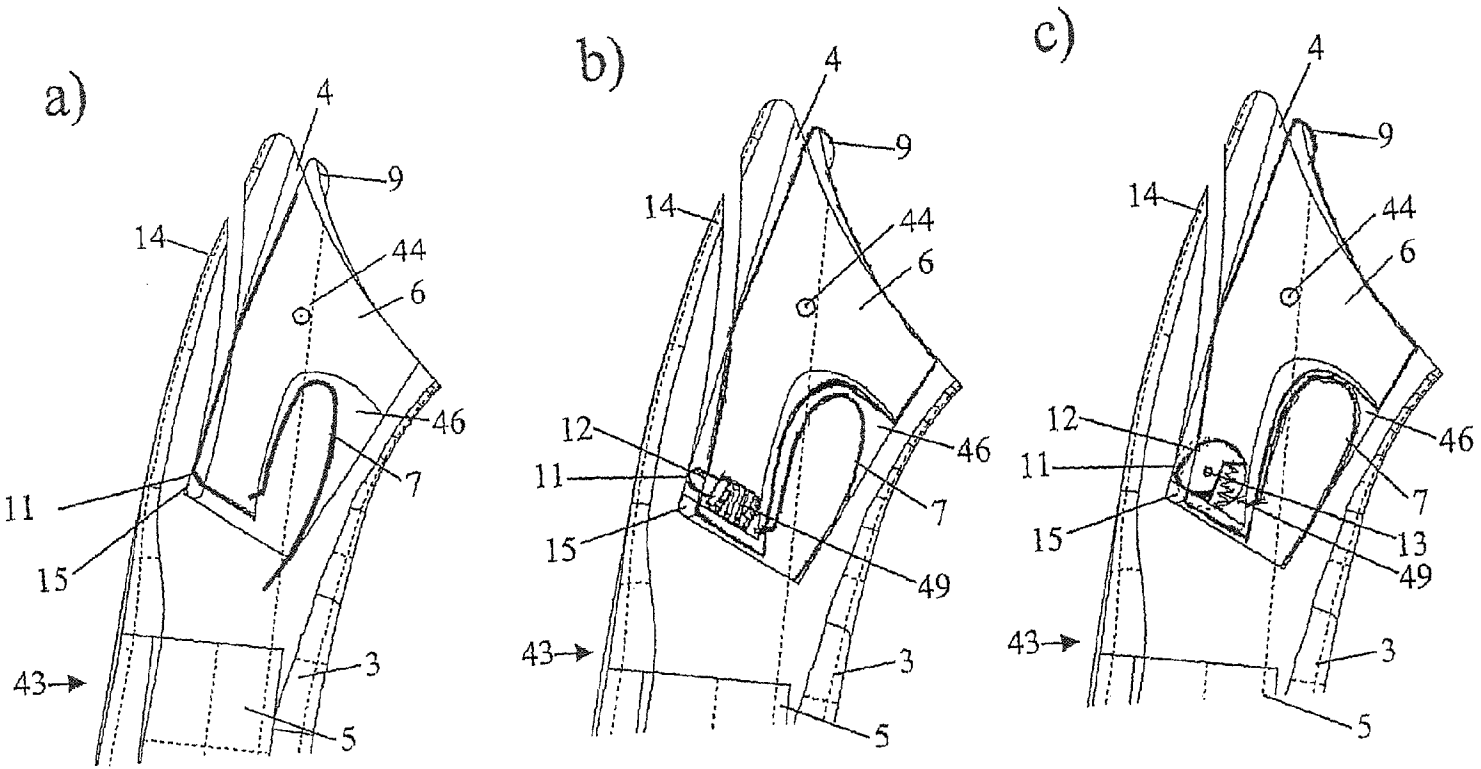
FIG. 5 shows different variants of a pole grip analogous to FIG. 4, a) illustrating a safety-activation means without a separate safety-activation element, b) illustrating a safety-activation means with a displaceably mounted safety-activation element, c) illustrating a safety-activation means with a rotatably mounted safety-activation element, d) illustrating a safety-activation means with a safety-activation element which can be elastically deformed as a whole, e) illustrating a safety-activation means in which the safety-activation element is arranged on the inside of the hook-like device, and f) illustrating a safety-activation means with a hook-like device which can be tilted as a whole.
Figure 5:
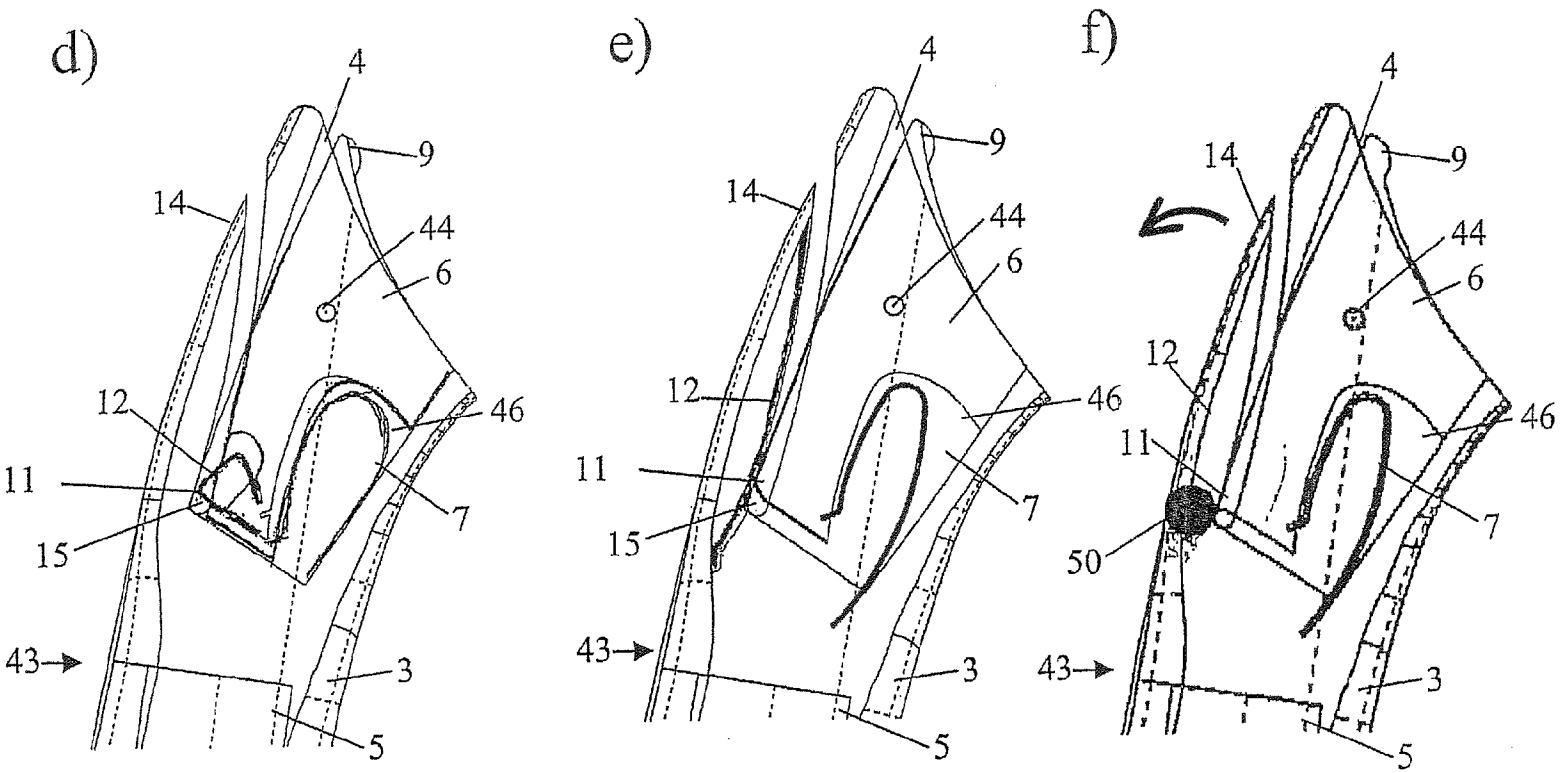

FIG. 5 illustrates other exemplary embodiments based on the exemplary embodiment according to FIG. 4.

FIG. 5*a*) illustrates the option of providing the nose 11 with an upwardly directed flank. If, in the case of this exemplary embodiment, the loop is subjected to pronounced pulling in the upward direction out of the slot, then the arresting block 6 will rotate, and this ensures safety activation.

A more specific safety-activation means is illustrated in FIG. 5*b*). In this case, the safety-activation element 12 is designed as a displaceable nose which is guided in a bore in the arresting block 6 and is braced against a helical spring 49. Here, in the case of the loop being subjected to pronounced pulling out of the slot, the entire safety-activation element 12, on which the nose 11 is integrally formed, is displaced into the arresting block 6 and thus releases the region 15.

An alternative safety-activation means is illustrated in FIG. 5*c*). In this case, the safety-activation element 12 is mounted such that it can be rotated about an axial element 13 and is braced against a spring 49. Here, when a loop is subjected to pronounced pulling out of the slot, the entire safety-activation element 12, on which the nose 11 is integrally formed, tilts into the arresting block 6 and releases the region 15 in the process.

A further alternative is illustrated in FIG. 5*d*). In this case, the safety-activation element 12 is designed as a leaf-spring-like element, although it may also be an elastomeric element. This element can be moved as a whole, and the region 15 is released by the nose 11, which is formed by this element, as a result of the entire element 12 being deformed when a loop is subjected to pronounced pulling out of the slot.

Another approach is used in the exemplary embodiment according to FIG. 5*e*). In this case, the safety-activation means is provided on the hook-like device 14. For this purpose, the hook-like device 14 has an internal clearance in which, once again, a leaf-spring-like element 12 is arranged. In the case of a pronounced force being exerted, this element yields in relation to the hook-like device 14 and thus likewise releases the region 15 in the manner of a safety-activation means.

A further approach is illustrated in FIG. 5*f*). In this case, the entire hook-like device 14 is mounted such that it can be rotated about an axial element 50. If a pronounced force emanates from the slot, then the entire hook-like device 14 rotates in the direction of the arrow illustrated and thus releases the region 15. The rotatable mounting of the hook-like device 14 is likewise ensured, for example, via a helical spring, counter to an adjustable force.

Figure 6:
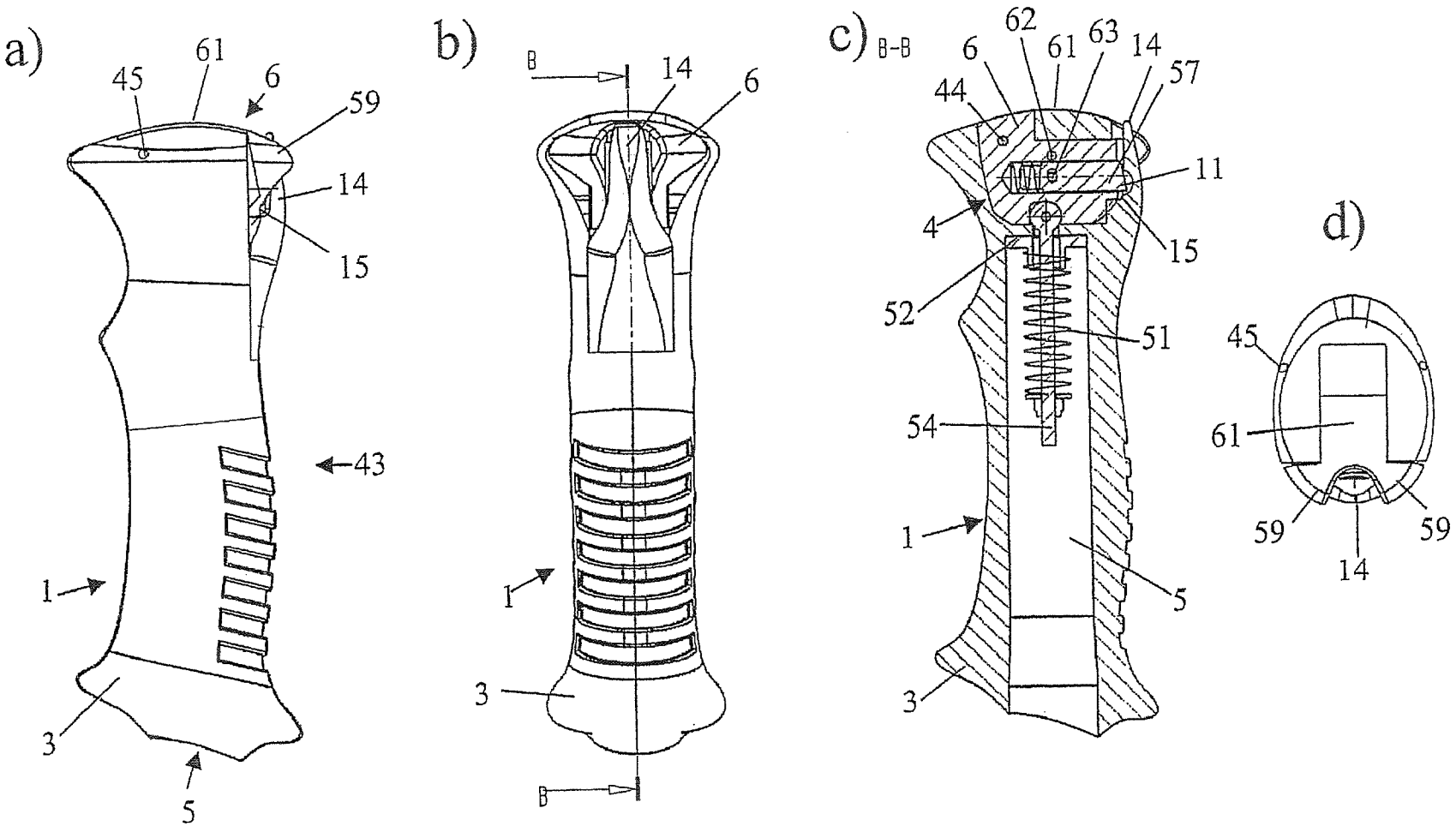
FIG. 6 shows the entire pole grip 1, a) illustrating a view from the side, b) illustrating a view from the rear, c) illustrating an axial section along line B-B from b), and d) illustrating a view of the pole grip from above.
Figure 7:
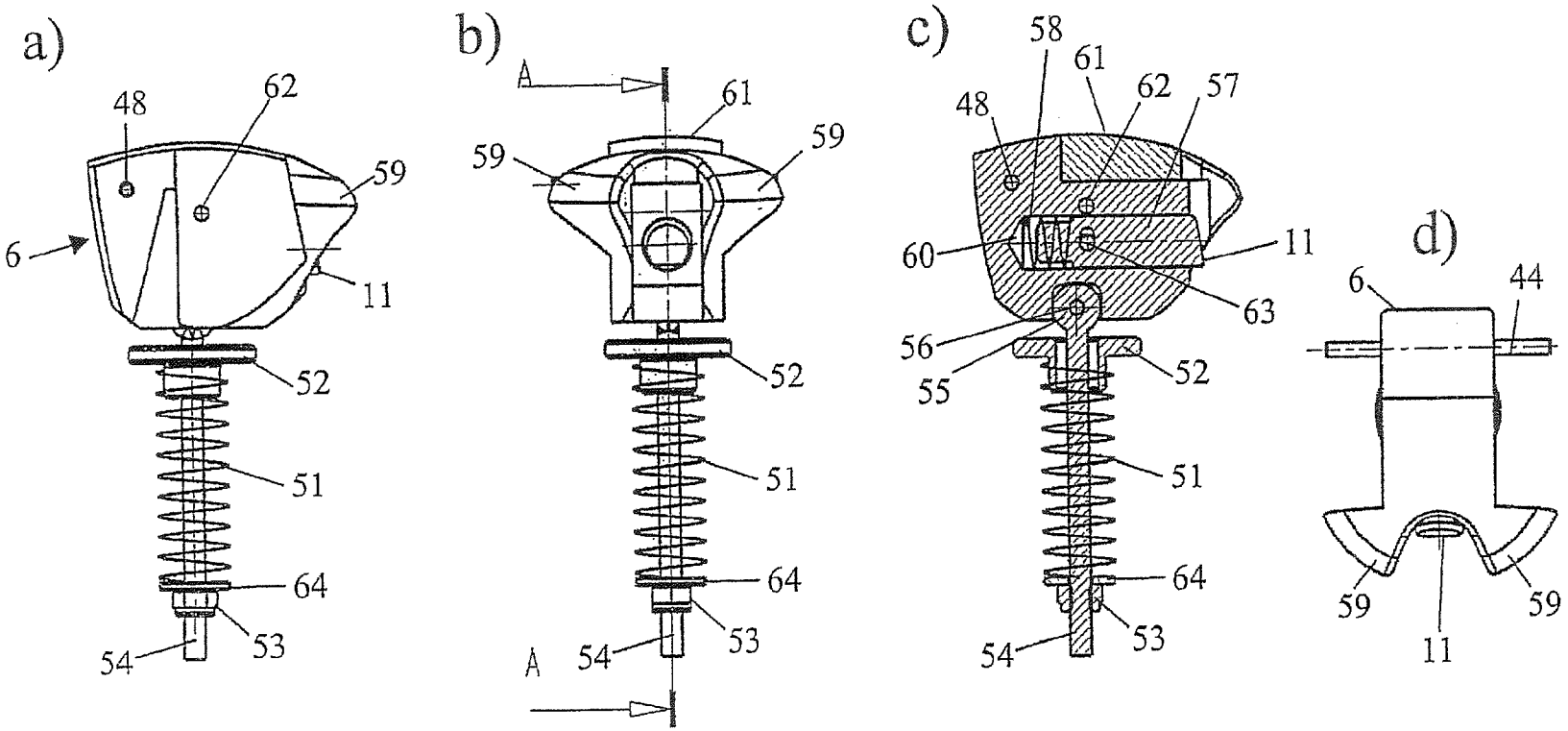
FIG. 7*a*) shows a view from the side of the arresting block 6 together with the elements fastening this arresting block 6 in the pole grip 1, b) shows a view from the rear, c) shows a section along line A-A in b), and d), finally, shows a view from above.

FIGS. 6 and 7 illustrate a further exemplary embodiment according to the invention. FIG. 6 illustrates the entire pole grip 1, FIG. 6*a*) illustrating a view from the side, and FIG. 6*b*) illustrating a view from the rear, that is to say from the hand side (arrow 43 in FIG. 6*a*)). FIG. 6*c*) illustrates an axial section along line B-B from FIG. 6*b*), and FIG. 6*d*) shows a view of the pole grip from above.

The pole grip 1 for a downhill ski pole, in turn, has a grip body 3 and a cavity 5, which serves for accommodating the pole shaft (not illustrated).

In this case, the retaining peg 14 is formed integrally with the grip body 3, as can be seen from FIG. 6*c*). It is also possible here, however, for the retaining peg 14 to be in the form of a separate element, in the manner of FIG. 1*f*) and of the elements 14 and 16 illustrated therein.

The grip body 3 has a recess 4 which is open at the top and in which an arresting block 6 is arranged. The arresting block 6 is illustrated in detail in FIG. 7.

On the top side, the arresting block 6 has an activating button 61, which will be described hereinbelow. The ergonomic shaping on the rear side of the top region of the pole grip 1 in this case is likewise formed by the arresting block 6, since the latter has, to the sides of the hook 14, two protrusions 59 which, as it were, surround the retaining peg 14 in the top region.

The retaining peg 14 is thus optimally embedded in the outer contour of the pole grip 1, and is not perceived as disturbing and it is possible for injuries to be avoided. Nevertheless, an ideal introduction opening remains from above for a cable loop 33, as illustrated in FIG. 2.

The arresting block 6 contains a pin 57 which is used for the automatic latching in, for example, of a cable loop 33. The pin 57 is arranged essentially horizontally and parallel to the direction of the arrow 43. It is mounted in a displaceable manner in the arresting block 6, in a recess 60 provided specifically for this purpose, the pin 57 being braced against the retaining peg 14 via a helical spring 58. The pin 57 has a restraining nose 11, which is preferably beveled from above and is of essentially horizontal design in the downward direction, in which case for example an eyelet or cable loop 33 which is introduced from above displaces the pin 57 in the rearward direction, counter to the stressing of the helical spring 58, and the cable loop is arrested beneath the pin 57 in the region 15.

FIG. 7*a*) shows an overall view from the side of the arresting block 6 together with the elements fastening this arresting block 6 in the pole grip 1. FIG. 7*b*) shows a view from the rear, that is to say from the direction of the arrow 43 in FIG. 6*a*), and FIG. 7*c*) shows a section along line A-A in FIG. 7*b*). FIG. 7*d*), finally, shows a view from above.

The entire arresting block 6 is retained in the recess 4, which is open at the top, in the pole grip 1. For this purpose, the recess 4 has a through-bore to the cavity 5. A securing pin 54 is attached to the arresting block 6 via an axial element 56, which projects through this through-bore into the cavity 5. On the top side, the securing pin 54 has an eye 55, for fastening the securing pin on the arresting block 6 in a rotatable manner by way of the axial element 56. At its bottom end, the securing pin 54 is provided with a thread.

The securing pin 54 or the arresting block 6 fastened thereon is braced in the downward direction, with the aid of a stop element 52 butting against the top of the cavity 5, by way of a helical spring 51 which, at one end, rests from beneath on a correspondingly provided shoulder on the stop element 52 and, at the other end, rests from above on a washer 64, which is adjusted via an adjusting nut 53 which is screwed onto the thread of the securing pin 54 from beneath.

This design has, inter alia, the following advantages:

First of all, the arresting block 6, which is produced as an entire unit, is very straight-forward to assemble or install. It can be pushed into the recess 4 in the pole grip 1 from above, in which case the securing pin 54, which is provided on the arresting block 6, is pushed through the through-bore between the recess 4 and the cavity 5. It is subsequently possible for, in the first instance, the stop element 52, and then the helical spring 51, to be pushed over the securing pin 54 in the cavity 5, from beneath, and, finally, the washer and the adjusting nut 53 can be screwed onto the thread of the securing pin 54. The resiliently elastic securing force in the downward direction to which the arresting block 6 is subjected via the helical spring 51 can be adjusted by the adjusting nut 53 being screwed upward to a greater or lesser extent or by the installation of different springs with a different spring constant or by virtue of the prestressing being changed by spacers. Finally, a rotary axial element 44 can be pushed in laterally through the bore 45 of the grip body, or through the bore 48 of the arresting block 6, as a result of which the arresting block 6 is then mounted in the recess 4 such that it can be rotated about the rotary axial element 44.

Secondly, this design provides for adjustable emergency activation of the entire arresting block 6. This is because, if the restraining nose 11 is subjected to excessive force from beneath by a cable loop 33 or an eyelet (for example in the event of a fall), then the entire arresting block 6 rotates about the rotary axial element 44, for example in the counterclockwise direction in FIG. 6*c*) and in FIG. 7*c*). This takes place until the region 15 is released and the cable loop 33 or the eyelet is released from the hook. This design then has the advantage, inter alia, that the activating force can be adjusted very straightforwardly by, for example, the pole shaft being removed from the cavity 5 and the adjusting nut 53 being adjusted from beneath, in accordance with requirements, by a corresponding tool. It is also conceivable for the spring to be adjusted via an adjusting device which is incorporated in, or beneath, the grip region and is, for example, in the form of a partially exposed knurled nut, in which case there is no need for the grip to be dismantled in order for the activating force to be changed. The use of a helical spring 51 also ensures this safety activation under a wide range of different temperature conditions and, moreover, the helical spring 51 is concealed to such good effect in the interior of the pole grip 1 that it is possible to avoid soiling, icing-up or the like.

If the eyelet or cable loop pushed over the retaining peg 14 is to be released from the region 15 under normal conditions, then an activating button 61 is provided, for this purpose, on the top side of the arresting block 6. A rotary axial element 62 is arranged horizontally, and transversely to the direction of the pin 57, in the arresting block 6. The element which forms the activating button 61 is mounted within the arresting block 6 such that it can be tilted about this axial element (in the clockwise direction in FIG. 6*c*)). Furthermore, a guide pin 63 is arranged in the pin 57, likewise horizontally and transversely to the pin 57. This guide pin 63 is likewise mounted in the element which forms the activating button 61.

If the activating button 61, which is formed integrally with the lateral protrusions 59, is pushed downward either in the region 61 or at the protrusions 59, for example by the thumb of the hand which is gripping the pole, then the element which forms the activating button tilts slightly downward as a whole and thus, upon rotation about the rotary axial element 62, pushes the pin 57 inward via the guide pin 63, counter to the force of the helical spring 58, consequently releases the region 15 in the upward direction and thus also releases a loop which has been arrested in this region.

This design is highly advantageous insofar as the protrusions 59 are ideally positioned for the desired activation, but undesired activation can nevertheless be fully avoided.

LIST OF DESIGNATIONS

1 Pole grip
3 Grip body
4 Recess in 3
5 Cavity in 3 for pole shaft
6 Arresting block

7 Spring
8 Stop bore for 7
9 Actuating button
10 Leg spring
11 Restraining nose
12 Safety-activation element
13 Axial element of 12
14 Retaining peg
15 Region for fastened loop/eyelet
16 Fastening plate
17 Slot for guide of 9
19 Guide peg for 7
20 Crosspiece
21 Fastening pin/screw
22 Axial pin
23 Bore in 6 for 22
24 Recess in 6
25 Glove
26 Thumb
27 Forefinger
28 Middle finger
29 Ring finger
30 Little finger
31 Encircling fastening device
32 Adjusting means for 31
33 Cable loop
34 Guide sleeve
35 Cable
36 Fastening for 35
37 Deflecting means for 35
38 Variable-length fastening for 35
39 Button for extended position
40 Button for retracted position
41 Pocket for 33
42 Recess in 14
43 Hand side
44 Rotary axial element of 6
45 Bore in 3 for 44
46 Recess for spring
47 Guide slot for spring
48 Bore in 6 for 44
49 Helical spring
50 Rotary axial element of 14
51 Helical spring
52 Stop element
53 Adjusting nut
54 Securing pin
55 Eye of 54
56 Axial element
57 Pin
58 Helical spring
59 Lateral protrusions of 6
60 Recess in 6 for 57
61 Activating button
62 Rotary axial element for 61
63 Guide pin for 57
64 Washer

The invention claimed is:

1. A pole grip for attaching to a pole having a pole axis, of the type comprising walking sticks, trekking poles, downhill ski poles, cross-country ski poles and Nordic walking poles, and for releasably coupling to a hand retaining device, such as a hand strap or glove, via a loop structure that is loop-like, ring-like or eyelet-like on said hand retaining device, comprising:

a grip body having a hand side, a top region and a bottom region, with a hole extending from the bottom region along the pole axis and being sized to receive a pole end, a hook-like device for fastening a hand-retaining device, the hook-like device being disposed in the top region of the grip body on the hand side, the hook-like device comprising a retaining peg having a first end secured to the grip body and a second free end, and being oriented essentially parallel to the pole axis but being offset on the hand side away from the grip body with the second free end forming an introduction slot with the grip body, wherein a cross section of the peg is sized to receive the loop structure of a hand retaining device and the depth of the introduction slot is greater than a width and a thickness of the retaining peg, displaceable or rotatable latching-in means disposed adjacent the hook-like device such that the loop structure of a hand retaining device, when pushed onto the free end of the hook-like device, is secured onto the hook-like device with a self latching action, and an elastically biased arresting block having a latching-in restraining nose, the arresting block being accommodated in a recess formed in the top region of the grip body, wherein the arresting block as a whole is, or the restraining nose arranged therein is, biased against the hook-like device via a resiliently elastic element, and wherein the arresting block is coupled to at least one activating button and the arresting block or the restraining nose is moveable against the force of the resiliently elastic element by manual activation of the button, whereby the self latching mechanism is released.

2. The pole grip as claimed in claim 1, wherein the hook-like device has a width in the range of 3-15 mm, the hook-like device having an essentially oval or lenticular cross section, at least in certain sections perpendicular to the pole axis, in which case a short, main axis is directed towards the grip body.

3. The pole grip as claimed in claim 1, wherein the introduction slot has a depth in the range of 5-30 mm.

4. The pole grip as claimed in claim 1, wherein the hook-like device is formed integrally as a part of the grip body.

5. The pole grip as claimed in claim 1, wherein the hook-like device is a separate component which is fastened on the grip body via a fastening plate by means of which the hook-like device can be fastened on the grip body from the hand side.

6. The pole grip as claimed in claim 1, wherein the recess is provided in the grip body from the hand side and/or from above.

7. The pole grip as claimed in claim 6, wherein the arresting block as a whole is, or retaining means arranged therein are, guided so as to be displaceable parallel to the direction of the recess, or in the horizontal direction, and it is biased against the hook-like device, which is arranged in front of the recess, via a spring.

8. The pole grip as claimed in claim 1, wherein the arresting block can be displaced from the outside, counter to the bias force, via the at least one actuating button, the self latching mechanism being released in the process, in which case, for this purpose, slots are provided laterally, in the grip body, in relation to the recess and, via these slots, actuating buttons arranged on both sides are operatively connected to the arresting block.

9. The pole grip as claimed in claim 1, wherein provided in or on the arresting block is the at least one activating button by way of which a retaining means arranged in the arresting block, in the form of a pin, can be displaced counter to the bias force, the self-latching mechanism being released in the process.

10. The pole grip as claimed in claim 1, wherein provided in or on the arresting block is the at least one activating button by way of which the arresting block or a retaining means arranged in the arresting block, can be displaced, the self-latching mechanism being released in the process, it being the case that the activating button is arranged on the top region and is directed toward the hook-like device, wherein the activating button has lateral protrusions which project on both sides of the hook-like device and essentially surround the tip of the hook-like device laterally.

11. The pole grip as claimed in claim 1, wherein the recess in the grip body open at the top and from the hand side and the arresting block is biased in the downward direction for emergency activation via an axial helical spring which is arranged in a cavity of the pole grip and the stressing of which can be adjusted preferably via an adjusting nut.

12. The pole grip as claimed in claim 1, wherein the arresting block is a displaceably and/or rotatably mounted element, on or in which latching-in means are arranged, wherein the element is biased in the downward direction for emergency activation via an axial helical spring which is arranged in a cavity of the pole grip and the stressing of which can be adjusted.

13. The pole grip as claimed in claim 11, wherein the arresting block is mounted in a rotatable manner about a horizontal axial element, which is arranged between the hook-like device and grip body essentially parallel to the plane of the slot, and it is biased against the hook-like device, arranged on the hand side, via a spring.

14. The pole grip as claimed in claim 13, wherein the arresting block is tiltable from the outside, counter to the spring force, via at least one actuating button, the self-latching mechanism being released in the process.

15. The pole grip as claimed in claim 1, wherein the restraining nose has a beveled flank toward the top, as seen in the direction of introduction, and which, in the position in which it is braced against the hook-like device, defines, in the downward direction, a region for the loop-like, ring-like or eyelet-like device which is enclosed counter to a force.

16. The pole grip as claimed in claim 15, wherein the restraining nose is arranged on or in the arresting block.

17. The pole grip as claimed in claim 15, wherein the restraining nose is arranged on the hook-like device.

18. The pole grip as claimed in claim 1, wherein the latching-in means are designed such that, in the event of loading in the direction of the opening of the hook-like device which goes beyond a normal usage force, emergency release of the loop-like, ring-like or eyelet-like device takes place.

19. The pole grip as claimed in claim 15, wherein the restraining nose is mounted in a rotatable manner about a preferably horizontal axial element arranged essentially perpendicularly to the opening direction of the recess, rotation in the upward direction, to release the region in the upward direction, being possible counter to a defined force.

20. The pole grip as claimed in claim 15, wherein the restraining nose is mounted in a displaceable manner, in which case displacement in the upward direction to release the region is possible counter to a defined force, and the force is ensured via a spring or a resilient element.

21. The pole grip as claimed in claim 11, wherein the restraining nose is braced by way of a leg spring or by way of a helical spring, or by way of an elastomer spring, into the rotary position, or displacement position, in which it closes off the region, this bracing being adjustable, in which case safety activation takes place only under a force of more than 80-250 N.

22. The pole grip as claimed in claim 1, wherein safety activation is realized via a yielding action in the region of the hook-like device.

23. The pole grip as claimed in claim 22, wherein the hook-like device can be displaced or tilted about an axial element, counter to a force, in the direction of the hand side to release the region.

24. The pole grip as claimed in claim 22, wherein a resilient region is provided on the hook-like device on the slot side, this resilient region being realized via a leaf spring or an elastic portion.

25. The pole grip as claimed in claim 1, having a hand-retaining device which can be fastened on the hand or a glove which has a movable and/or flexible loop between the thumb and forefinger, the hand-retaining device being provided for fastening on the hook-like device of a pole grip as claimed in claim 1.

26. The pole grip as claimed in claim 1, wherein the introduction slot has a depth in the range of 10-15 mm.

27. The pole grip as claimed in claim 1, wherein the hook-like device has a width in the range of 4-8 mm, the hook-like device having an essentially oval or lenticular cross section.

28. The pole grip as claimed in claim 1, wherein the hook-like device is a cutout in the grip body.

29. A pole grip for attaching to a pole having a pole axis, of the type comprising walking sticks, trekking poles, downhill ski poles, cross-country ski poles and Nordic walking poles, and for releasably coupling to a hand retaining device, such as a hand strap or glove, via a loop structure that is loop-like, ring-like or eyelet-like on said hand retaining device, comprising:

a grip body having a hand side, a top region and a bottom region, with a hole extending from the bottom region along the pole axis and being sized to receive a pole end, a hook-like device for fastening a hand-retaining device, the hook-like device comprising a retaining peg having a first end secured to the grip body and a second free end, and being oriented essentially parallel to the pole axis but being offset on the hand side away from the grip body with the second free end forming an introduction slot with the grip body, wherein a cross section of the peg is sized to receive the loop structure of a hand retaining device and the depth of the introduction slot is greater than a width and a thickness of the retaining peg, moveable latching-in means disposed adjacent the hook-like device such that the loop structure of a hand retaining device, when pushed onto the free end of the hook-like device, is secured onto the hook-like device with a self-latching action, and an elastically biased arresting block having a latching-in restraining nose, the arresting block being accommodated in a recess formed in the top region of the grip body, wherein the arresting block as a whole is, or the restraining nose arranged therein is, biased against the hook-like device via a resiliently elastic element, and wherein the arresting block is coupled to at least one activating button and the arresting block or the restraining nose is moveable against the force of the resiliently elastic element by manual activation of the button, whereby the self-latching mechanism is released.

* * * * *